United States Patent [19]

Brown

[11] Patent Number: 4,617,561

[45] Date of Patent: Oct. 14, 1986

[54] EMERGENCY LIGHT AND SMOKE ALARM SYSTEM

[75] Inventor: Kenneth A. Brown, West Simsbury, Conn.

[73] Assignee: Second Chance Systems, Inc., North Haven, Conn.

[21] Appl. No.: 710,554

[22] Filed: Mar. 11, 1985

[51] Int. Cl.[4] ..... G08B 17/10

[52] U.S. Cl. ..... 340/628; 200/60; 200/61.19; 200/61;58 R; 248/309.1; 340/321; 340/531; 340/630

[58] Field of Search ..... 340/628, 630, 531, 321, 340/548, 546; 248/309.1; 200/60, 61.03, 61.1, 61.19, 61.58

[56] References Cited

U.S. PATENT DOCUMENTS

| | | | |
|---|---|---|---|
| 2,148,323 | 2/1939 | Riner | 340/321 |
| 4,419,658 | 12/1983 | Jarosz et al. | 340/321 X |
| 4,432,041 | 2/1984 | Pfisterer et al. | 340/321 X |
| 4,438,428 | 3/1984 | Ober et al. | 340/630 X |

*Primary Examiner*—James L. Rowland
*Assistant Examiner*—Daniel Myer
*Attorney, Agent, or Firm*—Bachman & LaPointe

[57] ABSTRACT

An emergency light and smoke alarm system comprises a smoke detector mounted in a housing for detecting smoke and producing an audible and visual signal in response to the detected smoke. A flashlight is mounted on a bracket provided on the housing such that a portion of the bracket physically and electrically separates the battery terminals of the flashlight at their normal interface. When the flashlight is removed from the bracket the battery terminals are pushed into contact by a spring which turns on the flashlight.

5 Claims, 4 Drawing Figures

EMERGENCY LIGHT AND SMOKE ALARM SYSTEM

BACKGROUND OF THE INVENTION

The present invention relates to an emergency smoke alarm system and, more particularly, an emergency smoke alarm system which not only produces an audible signal but also a visual signal in response to detected smoke.

There are many types of smoke alarms presently in use today. While these alarms have undoubtedly saved numerous lives, certain serious problems are associated with them. For example, conventional smoke alarms, while indicating the presence of smoke, are not provided with a light source which would aid an individual in escaping from a smoke filled burning building. In addition, conventional smoke alarms do not provide a system which allows for the location of an individual within a smoke filled environment by firefighting personnel in the event the individual becomes overcome by smoke or the like.

Naturally, it would be highly desirable to provide an emergency smoke alarm system which includes a smoke detector for detecting smoke and producing an audible and visual signal in response to the detected smoke. In addition, it would be highly desirable to provide a smoke alarm system which includes a plurality of flashlights for use by individuals trapped in a smoke filled burning building so as to aid in their escape therefrom and/or indicate to firefighting personnel their location within the building.

Accordingly, it is the principal object of the present invention to provide an emergency light and smoke alarm system wherein a smoke detector upon detection of smoke produces both an audible and visual signal.

It is a further object of the present invention to provide an emergency light and smoke alarm system including a flashlight which is automatically turned on upon removal of the flashlight from the housing of the system.

It is a particular object of the present invention to provide an emergency light and smoke alarm system which includes a mechanism to aid an individual from escaping from a burning building and/or aid firefighting personnel to locate an individual in a smoke filled burning building.

It is still a further object of the present invention to provide an emergency light and smoke alarm system which incorporates a plurality of flashlights for use by individuals in a smoke filled burning building.

Further objects and advantages of the present invention will appear hereinbelow.

SUMMARY OF THE INVENTION

In accordance with the present invention the foregoing objects and advantages are readily obtained.

The present invention relates to an emergency light and smoke alarm system and, more particularly, an emergency smoke alarm system which not only produces an audible signal but also a visual signal in response to detected smoke. The emergency light and smoke alarm system of the present invention comprises a smoke detector mounted in a housing for detecting smoke and producing an audible and visual signal in response to the detected smoke. In accordance with a particular feature of the present invention, the housing is readily removable from the wall of a structure so as to enable one to carry the housing with them. The visual signal comprises a first flashlight lamp which is activated in response to the sensing of smoke by the smoke detector. A separate on-off switch is provided for turning the flashlight lamp on irregardless of the detection of smoke by the smoke detector. In accordance with a further particular feature of the present invention, the housing of the emergency light and smoke alarm system is provided with a bracket for receiving a second flashlight assembly. The bracket is provided with a separator plate for electrically separating the battery terminals of the flashlight at their normal interface when the flashlight is secured within the bracket. Removal of the flashlight from the bracket automatically connects the battery terminals so as to turn on the flashlight. The flashlight is always maintained in the on condition when dislocated from the bracket. The only method for turning off the flashlight is by inserting the separator plate between the battery terminals as noted above.

The emergency light and smoke alarm system of the present invention offers significant advantages over the many types of smoke alarms heretofore known in the prior art. Firstly, the emergency light and smoke alarm system provides both an audible and a visual signal in response to the detection of smoke by the smoke detector. In addition, the emergency light and smoke alarm system of the present invention is readily removed from the structure of a building so as to allow an individual to have a light source to aid the individual in escaping from a smoke filled burning building. Finally, the device of the present invention provides an additional flashlight which is automatically activated when removed from a bracket provided on the emergency system to again aid in an individual escaping from a burning building. By way of the emergency light and smoke alarm system of the present invention, by providing a flashlight which is continually operative once it is removed from the bracket of the system an individual who may have been overcome by the smoke conditions of a burning building may be readily located, due to the shining light, by firefighting personnel attempting to rescue individuals from a building. Thus, it can readily be seen that the emergency light and smoke alarm system of the present invention offers significant advantages which, heretofore, have not been able to be obtained in any of the prior art devices previously known.

Further objects and advantages of the present invention will appear hereinbelow.

DETAILED DESCRIPTION

Figure 4:
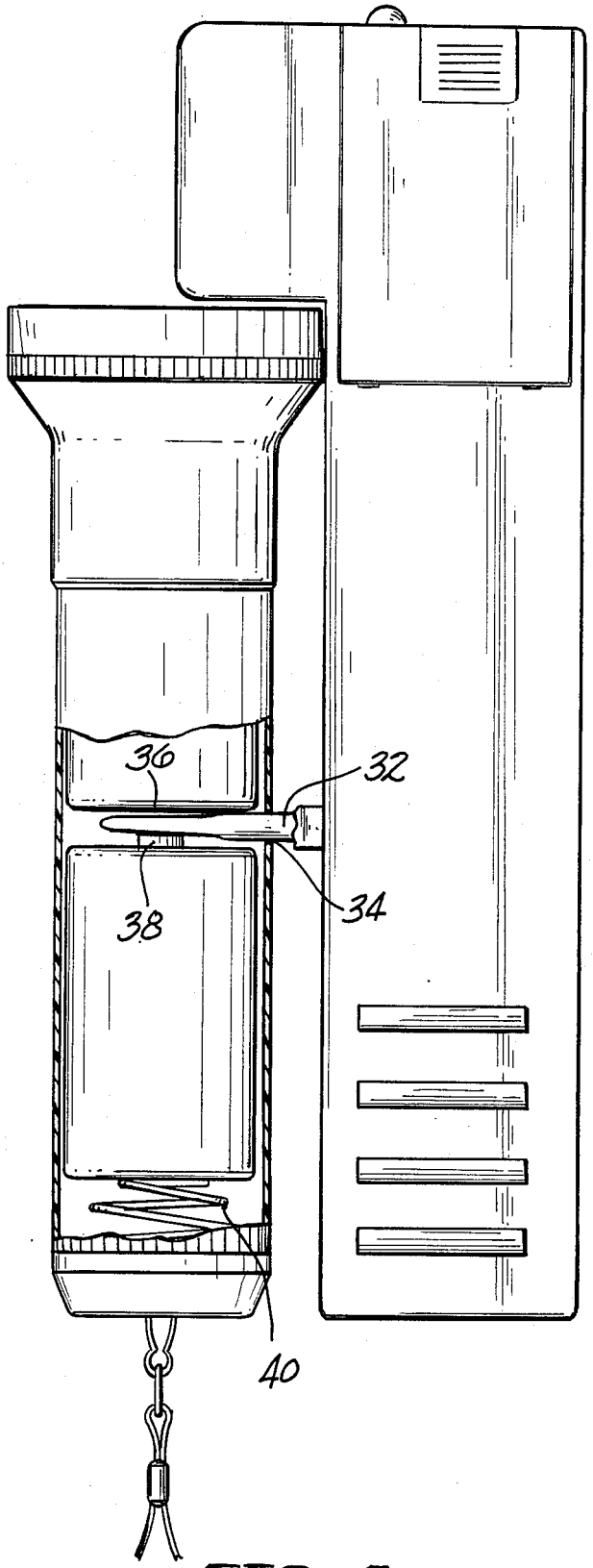
FIG. 4 is a side view of the emergency light and smoke alarm system of the present invention showing the flashlight in partial section with the separator plate.

Referring to the drawings, FIGS. 1–4 illustrate the emergency light and smoke alarm system 10 of the present invention. As seen therein, the system 10 comprises a housing 12 which contains the smoke detector 110, buzzer 116, light 124, batteries 122, 132 and circuitry used in the system of the present invention as will be described in detail with reference to FIG. 1. The housing 12 on the sides thereof is provided with a plurality of louvered openings 14 which readily allow for smoke to penetrate the interior of the housing 12. The housing 12 includes a removable door 16 which allows for access to the interior of the housing 12 so as to readily allow for the change of batteries when necessary. The top surface 18 of the housing 12 carries an indicating light 20 which, as will be described hereinbelow with reference to FIG. 1, continually blinks to indicate that the batteries within the housing 12 are still operative. The front surface of the housing 12 is provided with a transparent lens 22 which protects a lamp light 124 which is activated by the smoke detector upon the sensing of smoke by same as will be discussed in detail hereinbelow with reference to FIG. 1. An on-off switch 25 is provided on the side of housing 12 for activating the lamp light 124 behind lens 22 independent of the sensing by the smoke detector 110 of smoke within the housing 12. The front of the housing 12 is provided with a bracket 24 in which a flashlight 26 is received. The bracket 24 comprises a substantially semicircular shaped member 28 adapted to receive the body 30 of the flashlight 26. As can be seen in FIG. 4 a separator plate 32 is provided in the bracket 24. The separator plate is adapted to penetrate an opening 34 provided in the body 30 of the flashlight so as to physically and electrically separate the battery terminals 36 and 38 located within the body 30 at the normal interface of the battery terminals when the flashlight 26 is removed from the bracket 24 and thus the separator plate 32, spring 40 provided in the flashlight 30 biases the terminals 36 and 38 of the batteries together so that electrical contact is made and the flashlight is lit.

Figure 1:
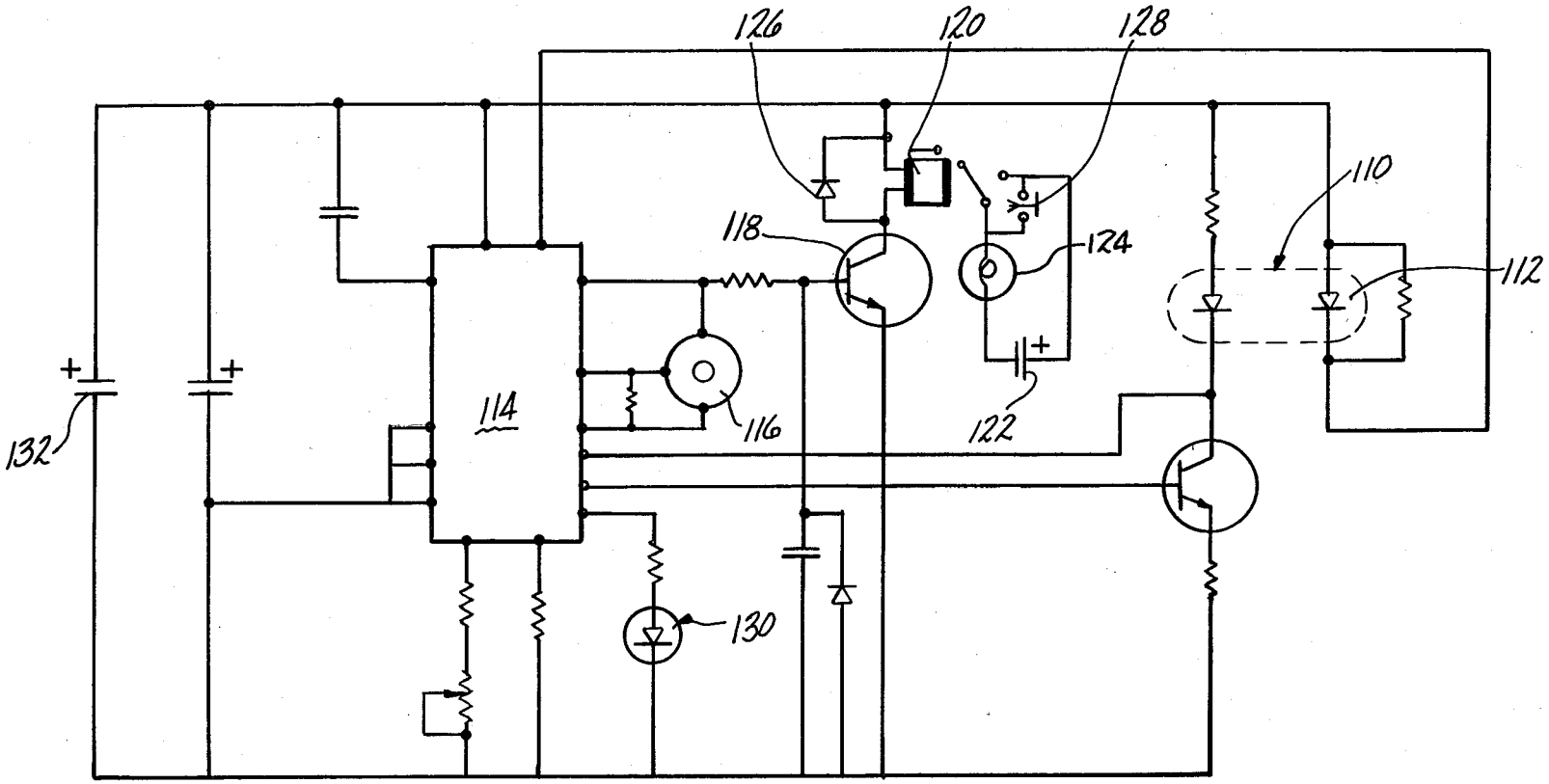
FIG. 1 is a schematic circuit diagram illustrating an embodiment of an electrical circuit device which is usable in the emergency light and smoke alarm system of the present invention.
Figure 2:
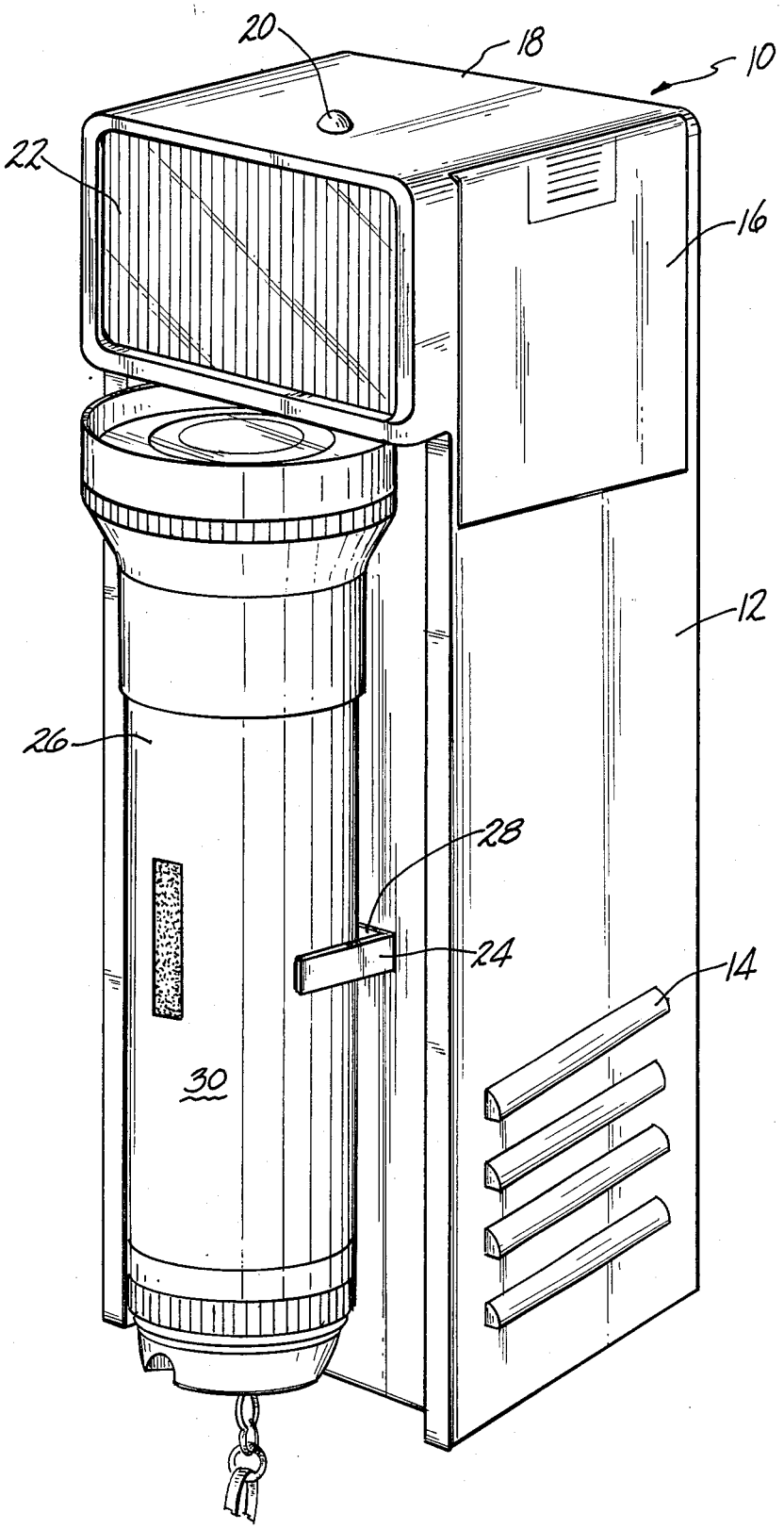
FIG. 2 is a perspective view of the emergency light and smoke alarm system of the present invention.
Figure 3:
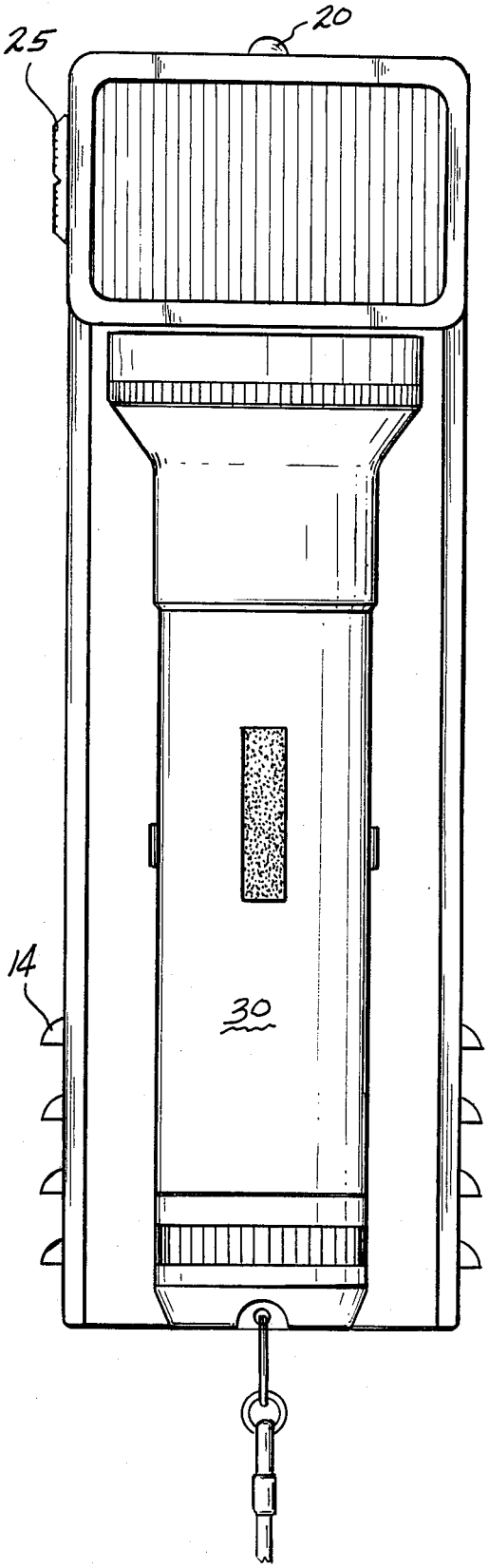
FIG. 3 is a front view of the emergency light and smoke alarm system of the present invention.

Referring now to FIG. 1 an electrical circuit is shown for carrying out the function of the emergency light and smoke alarm system of the present invention. An optoelectric smoke detector 110 is provided within the housing 12 of the system of the present invention for sensing the presence of smoke within the housing 12. The detector 110 may be of any conventional design and may utilize a photo-electric type of detector or an ionization type of detector as is well known in the art. Upon sensing of smoke by the detector 110 a signal is generated by photodiode 112 and is applied to the integrated circuit 114. The signal received by integrated circuit 114 actuates the buzzer 116 so as to produce an audible signal therein. At the same time the integrated circuit 114 causes transistor 118 to actuate a relay 120 which is normally in its open condition. Upon actuation by the integrated circuit 114, the normally opened contacts of relay 120 are closed applying current from battery 122 to flashlight lamp 124 causing the lamp to light thereby producing a visual signal. A diode 126 suppresses the induced voltage generated when the relay 120 is de-energized thereby allowing lamp 124 to stay on for a short period of time after smoke has dissipated. An override on-off switch 128 corresponding to switch 25 as shown in FIG. 3 is provided for activating the lamp 124 independent of the position of the relay 120. Indicating light 130 corresponding to the light 20 shown in FIGS. 2–4 is caused to flash intermittently by the integrated circuit 114 via battery 132 as long as battery 132 is functional.

In view of the foregoing the operation of the emergency light and smoke alarm system of the present invention is readily understood. Blinking light 20 operated by a battery 132 continually blinks to indicate battery 132 is functional. Upon the sensing of smoke by the smoke detector in case 12 an audible buzzer is activated via the battery power pack contained in the housing 112. At the same time the light source contained within the housing 12 is activated so as to emit a visual signal. The lamp may be activated by switch 25 independent of the detection of smoke within the housing 12 by the smoke detector 110.

Thus, it is apparent from the foregoing that the present invention provides an improved emergency light and smoke alarm system which overcomes the deficiencies and problems of known prior art devices.

While the preferred embodiment of the present invention provides a specific electrical circuitry for operation of the emergency light and smoke alarm system of the present invention it should be appreciated that various modifications, alterations and changes may be made to the circuitry without departing from the spirit and scope of the present invention as defined herein in the appended claims.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A portable emergency light and smoke alarm system comprising a portable housing having a mounting bracket; a smoke detector mounted in said housing for sensing the presence of smoke; audible alarm means mounted in said housing and operably connected to said smoke detector for sounding an audible signal upon the sensing of smoke by said smoke detector; light means mounted in said housing and operably connected to said smoke detector for producing a visual signal upon the sensing of smoke by said smoke detector; DC power means mounted in said housing; circuit means connected to said smoke detector, said audible alarm means, said light means and said DC power means for activating said smoke detector, said audible alarm means and said light means by said DC power means upon the sensing of smoke by said smoke detector; and a flashlight mounted on said bracket of said housing, said flashlight having a DC power source for activating said flashlight wherein said bracket includes means for deactivating said DC power source of said flashlight so as to maintain said flashlight in the off position when said flashlight is mounted on said bracket and wherein said DC power source is activated automatically upon removal of said flashlight from said bracket so as to activate said flashlight.

2. An emergency light and smoke alarm system according to claim 1 including an indicating light means for indicating the condition of said means for supplying electrical power.

3. An emergency light and smoke alarm system according to claim 1 wherein said means for separating said battery terminals comprises a separator plate.

4. An emergency light and smoke alarm system according to claim 1 wherein said housing is provided with a plurality of louvered openings so as to allow smoke to penetrate the housing.

5. An emergency light and smoke alarm system according to claim 1 further including a manually actuated control means for operating said lamp independent of the detection of smoke by said smoke detector.

* * * * *